US011504761B2

(12) United States Patent
Amadori et al.

(10) Patent No.: US 11,504,761 B2
(45) Date of Patent: Nov. 22, 2022

(54) FEED MECHANISM FOR POCKETED SPRING STRANDS

(71) Applicant: Spuhl GMBH, Wittenbach (CH)

(72) Inventors: Luciano Amadori, Forli FC (IT); Christoph Bischof, Forli FC (IT)

(73) Assignee: Spühl GmbH, Wittenbach (CH)

( * ) Notice: Subject to any disclaimer, the term of this patent is extended or adjusted under 35 U.S.C. 154(b) by 333 days.

(21) Appl. No.: 16/975,187

(22) PCT Filed: Mar. 14, 2019

(86) PCT No.: PCT/EP2019/056424
§ 371 (c)(1),
(2) Date: Aug. 24, 2020

(87) PCT Pub. No.: WO2019/175314
PCT Pub. Date: Sep. 19, 2019

(65) Prior Publication Data

US 2021/0086253 A1 Mar. 25, 2021

(30) Foreign Application Priority Data

Mar. 14, 2018 (EP) ..... 18161802

(51) Int. Cl.
*B21F 23/00* (2006.01)
*B65B 63/04* (2006.01)
(Continued)

(52) U.S. Cl.
CPC ..... *B21F 23/005* (2013.01); *B68G 9/00* (2013.01); *B68G 15/00* (2013.01); *B65B 35/30* (2013.01); *B65B 63/04* (2013.01); *B65B 65/00* (2013.01)

(58) Field of Classification Search
CPC ..... B21F 23/005; B68G 9/00; B68G 15/00; B65B 35/30; B65B 63/04; B65B 65/00; B65G 47/52
See application file for complete search history.

(56) References Cited

U.S. PATENT DOCUMENTS 3,807,117 A * 4/1974 Abrams ..... B65B 21/245 53/553
2001/0042360 A1* 11/2001 Santis ..... B68G 9/00 53/529
(Continued)

FOREIGN PATENT DOCUMENTS

CN 101024479 A 8/2007
CN 201809161 U 4/2011
(Continued)

OTHER PUBLICATIONS

European Patent Office; Search Report in related International Patent Application No. PCT/EP2019/056424 dated Apr. 5, 2019; 3 pages.
(Continued)

*Primary Examiner* — Sarang Afzali
*Assistant Examiner* — Darrell C Ford
(74) *Attorney, Agent, or Firm* — Wood Herron & Evans LLP

(57) ABSTRACT

A feed mechanism for pocketed spring strands is provided with at least one index wheel having a plurality of blades. The feed mechanism is provided with a motor. The at least one index wheel includes a first support member which is rotatable about a first rotation axis and carries a first support element which supports a shaft element of the blade to be tiltable about a tilt axis extending in parallel to the first rotation axis. The at least one index wheel includes a second support member which is rotatable about a second rotation axis which extends in parallel to the first rotation axis and
(Continued)

carries a second support element which is slidable along the shaft element of the blade and supports the shaft element to be tiltable about the tilt axis.

15 Claims, 5 Drawing Sheets

(51) Int. Cl.

| | |
|---|---|
| ***B65B 65/00*** | (2006.01) |
| ***B65B 35/30*** | (2006.01) |
| ***B68G 9/00*** | (2006.01) |
| ***B68G 15/00*** | (2006.01) |

(56) References Cited

U.S. PATENT DOCUMENTS

2004/0103618 A1* 6/2004 De Santis ..... B65B 9/073 53/550
2010/0326012 A1* 12/2010 Blunschi ..... B68G 9/00 53/114
2016/0362259 A1* 12/2016 Papsdorf ..... B65B 35/36

FOREIGN PATENT DOCUMENTS

| | | | |
|---|---|---|---|
| CN | 102083740 | A | 6/2011 |
| CN | 102173373 | B | 4/2015 |
| CN | 207030354 | U | 2/2018 |
| DE | 9210704 | U1 | 9/1993 |
| WO | 2009103173 | A1 | 8/2009 |

OTHER PUBLICATIONS

Chinese Patent Office; Office Action and Search Report in related Chinese Patent Application No. 2019800175581 dated May 17, 2021; 5 pages.

* cited by examiner

FEED MECHANISM FOR POCKETED SPRING STRANDS

FIELD OF THE INVENTION

The present invention relates to a feed mechanism for pocketed spring strands and to a pocketed spring assembly machine comprising one or more such feed mechanisms.

BACKGROUND OF THE INVENTION

Mattresses, sofas or other bedding or seating furniture may be provided with innerspring units formed of pocketed springs. The pocketed springs may for example include a spring which is formed of a metallic wire coil and a pocket formed of a nonwoven fabric which encloses the spring. In typical innerspring units, the pocketed springs are provided in the form of strands which include multiple pocketed springs enclosed by pockets formed from the same fabric sheet(s). An innerspring unit may then be formed by joining multiple pocketed spring strands of to each other, e.g., by welding, gluing or the like. This is preferably accomplished in an automated manner, using a pocketed spring assembly machine which receives the multiple pocketed spring strands, aligns the pocketed spring strands, and joins the pocketed spring strands to form the innerspring unit. For this purpose, it is typically required that the pocketed spring strands are fed in a well-defined manner into the pocketed spring assembly machine.

Accordingly, there is a need for techniques which allow for efficiently and precisely feeding a pocketed spring strand into a pocketed spring assembly machine.

BRIEF SUMMARY OF THE INVENTION

The present invention provides a feed mechanism and a pocketed spring assembly machine. The dependent claims define further embodiments.

Accordingly, an embodiment provides a feed mechanism for pocketed spring strands. The feed mechanism comprises an index wheel having a plurality of blades for engaging between pocketed springs of a pocketed spring strand. Further, the index wheel comprises a motor for driving rotation of the at least one index wheel. Accordingly, the pocketed spring strand can be conveyed by rotation of the index wheel, while at the same time ensuring precise positioning of the individual pocketed springs of the pocketed spring strand. The index wheel comprises a first support member which is rotatable about a first rotation axis. The first support member comprises, for each of the plurality of blades, a first support element which supports a shaft element of the blade to be tiltable about a tilt axis extending in parallel to the first rotation axis. Further, the index wheel comprises a second support member which is rotatable about a second rotation axis extending in parallel to the first rotation axis. The second support member comprises, for each of the plurality of blades, a second support element which is slidable along the shaft element and supports the shaft element of the blade to be tiltable the said tilt axis. The first support member and the second support member are movable relative to each other to set a parallel shift of the first rotation axis and the second rotation axis.

In the feed mechanism, the parallel shift of the first rotation axis and the second rotation axis can be used to efficiently set a spacing of the blades when engaging the pocketed spring strand. If the first rotation axis and the second rotation axis are aligned, the spacing of the blades may be defined by an angular spacing of the first support elements on the first support member and an angular spacing of the second support elements on the second support member. If the parallel shift is increased, for some of the blades the second support member will slide along the shaft element towards or away the first support member, at the same time tilting the shaft element about the tilt axis. For a given blade, this effect varies as the index wheel rotates. Accordingly, the spacing between two neighboring index wheels can be adjusted by varying the parallel shift of the first support member and the second support member. For example, this can be used to set the spacing between the neighboring blades to correspond to a diameter of the springs of the pocketed spring strand.

According to an embodiment, the index wheel may further comprise a Cardan joint mechanism coupling the first support member and the second support member. By means of the Cardan joint mechanism, it can be efficiently ensured that the first support member and the second support member rotate synchronously, while still allowing the above-mentioned setting of the parallel shift of the first rotation axis and the second rotation axis.

According to an embodiment, the index wheel comprises a sleeve which is arranged coaxially with one of the first rotation axis and the second rotation axis, receives a portion of the other of the first rotation axis and the second rotation axis, and limits the parallel shift of the first rotation axis and the second rotation axis. In this way, adjustment and movement of index wheel may be controlled in an efficient manner.

According to an embodiment, the sleeve accommodates the Cardan joint mechanism. In this way, the index wheel may be provided with a compact structure.

According to an embodiment, the first support elements are distributed with equal angular spacings around the first rotation axis and the second support elements are distributed with the same equal angular spacings around the second rotation axis. However, it is noted that other arrangements are possible as well. For example, by using a an angular spacing which varies over cycle around the first rotation axis and the second rotation axis, the spacing of the blades could be varied in accordance with different spring diameters used in the pocketed spring strand.

According to an embodiment, the feed mechanism comprises a belt drive mechanism for coupling the motor to the index wheel. By using the belt drive mechanism, the coupling of the motor to the index wheel can be provided in an efficient manner while at the same time allowing shifting of the first rotation axis and/or the second rotation axis. Further, the belt drive mechanism may be used for efficiently driving rotation of multiple index wheels of the feed mechanism.

According to an embodiment, the feed mechanism comprises a further motor for moving the first support member and the second support member of the index wheel relative to each other to set the parallel shift of the first rotation axis and the second rotation axis. In this way, the parallel shift can be set precisely and in an automatically controlled manner.

As mentioned above, the feed mechanism may comprise multiple index wheels. These multiple index wheels may each have a configuration as described above. Accordingly, in an embodiment the feed mechanism comprises a further index wheel having a plurality of blades for engaging between the pocketed springs of the pocketed spring strand. The further index wheel comprises a third support member which is rotatable about a third rotation axis and comprises, for each of the plurality of blades of the further index wheel, a first support element which supports a shaft element of the blade to be tiltable about a tilt axis extending in parallel to the third rotation axis. Further, the further index wheel comprises a fourth support member which is rotatable about a fourth rotation axis extending in parallel to the third rotation axis and comprises, for each of the plurality of blades of the further index wheel, a second support element which is slidable along the shaft element of the blade and supports the shaft element to be tiltable about the tilt axis. The third support member and the fourth support member are movable with relative to each other to set a parallel shift of the third rotation axis and the fourth rotation axis. Accordingly, also the further index wheel may allow for adjusting the spacing of the blades when engaging the pocketed spring strand by setting the parallel shift of the third rotation axis and the fourth rotation axis.

According to an embodiment, rotation of the index wheel and rotation of the further index wheel are driven by the same motor. In this way, complexity of the feed mechanism may be reduced. Further, using the same motor to drive rotation of the index wheel and rotation of the further index wheel may facilitate providing synchronous rotation of the index wheel and the further index wheel.

According to an embodiment, the feed mechanism comprises a belt drive mechanism for coupling the motor to the index wheel and to the further index wheel. In this way, the coupling of the motor to the index wheel and the further index wheel can be provided in an efficient manner while at the same time allowing shifting of the first rotation axis, the second rotation axis, the third rotation axis, and/or the third rotation axis.

According to an embodiment, the index wheel and the further index wheel are arranged on opposite sides of the pocketed spring strand and rotation of the further index wheel is driven by the motor in a direction which is opposite to rotation of the first index wheel. Accordingly, the pocketed spring strand can be conveyed in a precisely controlled manner between the index wheel and the further index wheel.

According to an embodiment, the feed mechanism comprises a further motor for moving the first support member and the second support member relative to each other to set the parallel shift of the first rotation axis and the second rotation axis, and for moving the third support member and the fourth support member relative to each other to set the parallel shift of the third rotation axis and the fourth rotation axis. Accordingly, the same motor can be used for both index wheels to set the parallel shift precisely and in an automatically controlled manner.

According to an embodiment, the feed mechanism comprises a spindle drive coupling the further motor to the index wheel and the further index wheel. The spindle drive may be used for efficiently translating a rotational movement of the motor into the parallel shift. Furthermore, the spindle drive may be used to ensure that the setting of the parallel shift of the first rotation axis and the second rotation axis and the parallel shift of the third rotation axis and the fourth rotation axis occurs in a symmetric manner.

According to a further embodiment, a pocketed string assembly machine is provided. The pocketed spring assembly machine comprises at least one feed mechanism according to any one of the above embodiments.

BRIEF DESCRIPTION OF DRAWINGS

Embodiments of the invention will be described with reference to the accompanying drawings.

DETAILED DESCRIPTION OF EMBODIMENTS

Exemplary embodiments of the invention as explained in the following relate to a feed mechanism for a pocketed spring assembly machine. In the illustrated examples, it is assumed that the feed mechanism is based on two oppositely rotating index wheels, which convey a pocketed spring strand to be fed into the pocketed spring assembly machine in between them. However, it is noted that in other implementations other arrangements of one or more index wheels could be used, e.g., a single index wheel placed next to a guide surface, so that a pocketed spring strand to be fed into the pocketed spring assembly machine is conveyed between the index wheel and the guide surface, or be described with reference to the drawings. While some embodiments will be described in the context of specific fields of application, such as in the context of a vehicle seat, the embodiments are not limited to this field of application. The features of the various embodiments may be combined with each other unless specifically stated otherwise.

Figure 1:
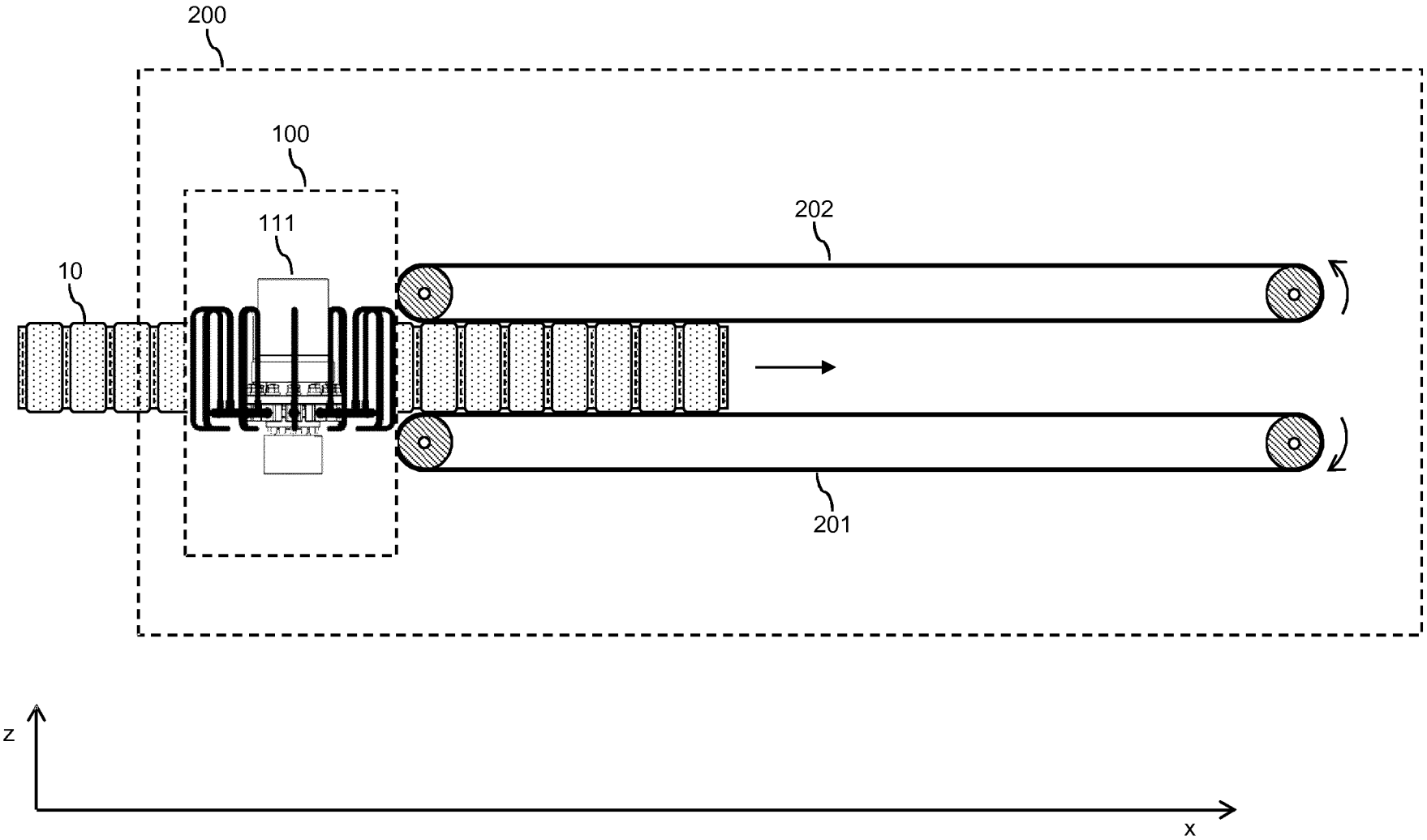
FIG. 1 schematically illustrates feed mechanism for a pocketed spring assembly machine according to an embodiment of the invention.

FIG. 1 shows a sectional view for schematically illustrating a feed mechanism 100 according to an embodiment. The feed mechanism 100 has the purpose of feeding a pocketed spring strand 10 into a pocketed spring assembly machine 200. In the illustrated example, the pocketed spring assembly machine 200 comprises a pair of conveyor belts 201, 202, which transport the pocketed spring strand 10 fed by the feeding mechanism 100 in an x-direction. However, it is noted that the pocketed spring assembly machine 200 also comprises further components for conveying, positioning, and joining pocketed spring strands fed into the pocketed spring assembly machine 200, which have not been illustrated for the sake of a better overview.

The feed mechanism 100 is provided with a first index wheel 111 rotatable about a z-direction, i.e., perpendicular to a direction of conveying the pocketed spring strand into the pocketed spring assembly machine 200. Further, the is provided with a second index wheel which is arranged on an opposite side of the pocketed spring strand 10 and is not visible in in the view of FIG. 1. Similar to the first index wheel 111, also the second index wheel is rotatable about the z-direction. As further explained below, each of the index wheels is provided with a plurality of blades extending away, which during rotation of the index wheels engage between two neighboring pocketed springs of the pocketed spring strand 10 and push the pocketed springs toward the conveyor belts 201, 202. A rotational speed of the index wheels may be adjusted to match a conveying speed of the conveyor belts 201, 202. However, in some scenarios the rotational speed of the index wheels may also be set to deviate from the conveying speed of the conveyor belts 201, 202. For example, the rotational speed of the index wheels could be adjusted to achieve a feeding speed of the pocketed spring strand 10 which is higher than the conveying speed of the conveyor belts 201, 202, thereby achieving a compression of the pocketed spring strand 10 along the conveying direction.

Figure 2A:
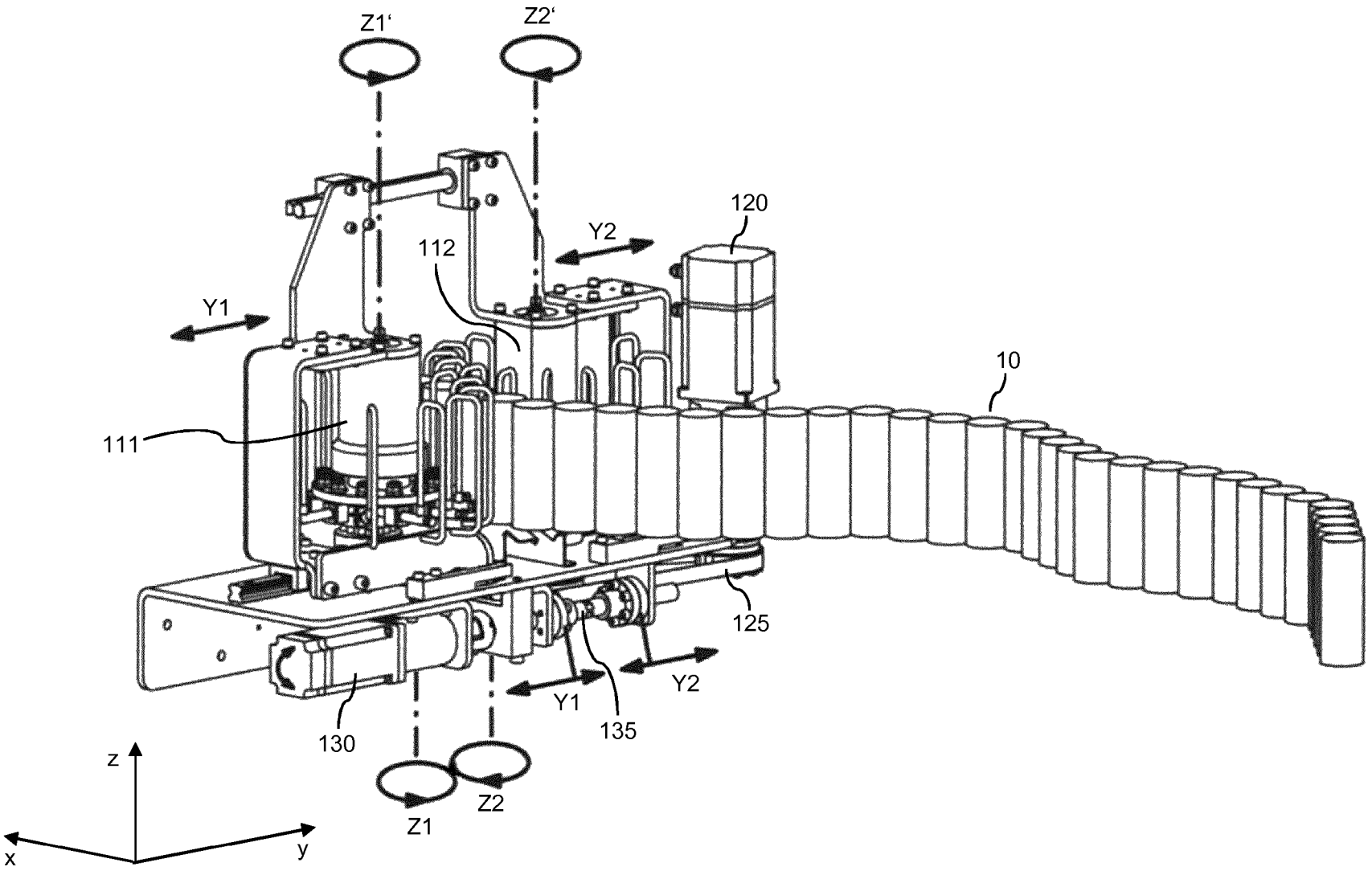
FIG. 2A shows a perspective view of the feed mechanism.
Figure 2B:
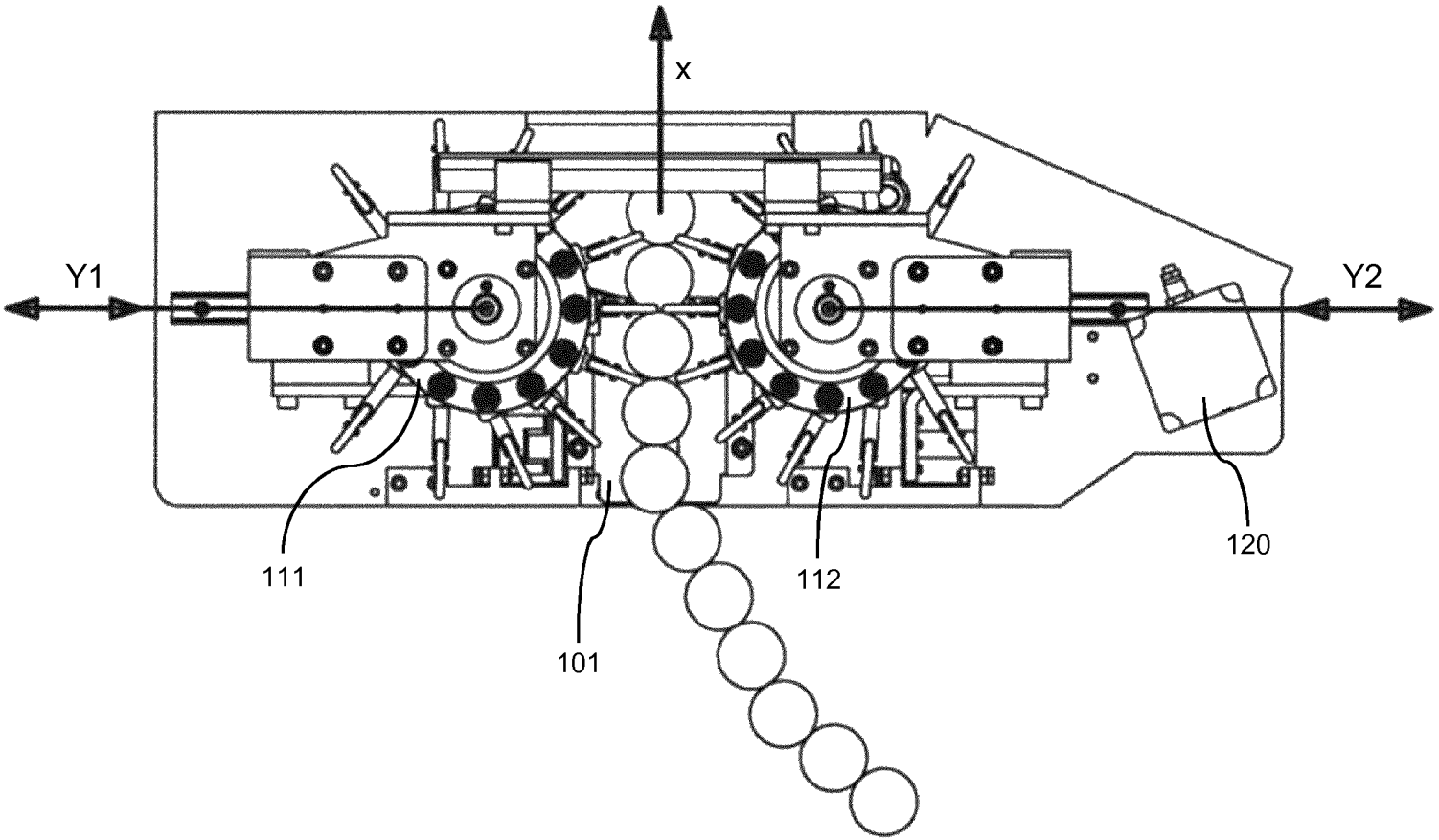
FIG. 2B shows a top view of the feed mechanism.

FIG. 2A shows a perspective view and FIG. 2B a top view for illustrating further details of the feed mechanism 100. As illustrated, the first index wheel 111 and the second index wheel 112 are offset from each other along a y-direction, which is perpendicular to the x-direction and z-direction, and face each other on opposite sides of a feeding channel 101 for the pocketed string strand 10. Some of the blades of each index wheel 111, 112 extend into the feeding channel 101 and form compartments which receive individual pocketed springs of the pocketed spring strand 10. Upon rotation of the index wheels in opposite directions, in the perspective of FIG. 2B counterclockwise for the first index wheel 111 and clockwise for the second index wheel 111, the compartments move in the x-direction, pushing the pocketed springs of the pocketed string strand 10 one by one between the conveyor belts 201, 202.

As further illustrated, the feed mechanism 100 also includes a motor for driving rotation of the first index wheel 111 and the second index wheel 112. In the illustrated example, a belt drive mechanism 125 couples the motor 122 both the first index wheel 111 and the second index wheel 112 and also ensures that the direction of rotation of the second index wheel 112 is opposite to the direction of rotation of the first index wheel 111.

FIG. 2A also illustrates rotation axes of the first index wheel 111 and the second index wheel 112. As further explained below, each of the index wheels 111, 112 is provided with a two-part configuration with two rotation axes. A first rotation axis of the first index wheel 111 is denoted with Z1, and a second rotation axis of the first index wheel 111 is denoted with Z1'. A first rotation axis of the second index wheel 112 is denoted with Z2, and a second rotation axis of the second index wheel 112 is denoted with Z2'. The first rotation axis Z1 and the second rotation axis Z1' of the first index wheel 111 can be shifted with respect to each other along the y-direction, to set a parallel shift Y1. Similarly, the first rotation axis Z2 and the second rotation axis Z2' of the second index wheel 112 can be shifted with respect to each other along the y-direction, to set a parallel shift Y2.

For controlling the parallel shifts Y1, Y2, the feed mechanism is provided with a further motor 130 and a spindle drive 135 which couples the motor 132 the first index wheel 111 and to the second index wheel 112. In the illustrated example, the spindle drive 135 translates rotational motion of the motor 130 into a shift of the first rotation axis Z1 of the first index wheel 111 along the y-direction. The same rotational motion of the motor 130 translates into an oppositely directed shift of the same size of the first rotation axis Z2' of the second index wheel 112. The second rotation axis Z1' of the first index wheel 111 and the position of the second rotation axis Z2' of the second index wheel 112 are not moved by the action of the motor 130. However, it would also be possible to obtain the parallel shifts Y1, Y2 by moving only the second rotation axes Z1', Z2', without moving the first rotation axes Z1, Z2, or to obtain the parallel shifts Y1, Y2 by moving both the first rotation axes Z1, Z2 and the second rotation axes Z1', Z2'.

Figure 3:
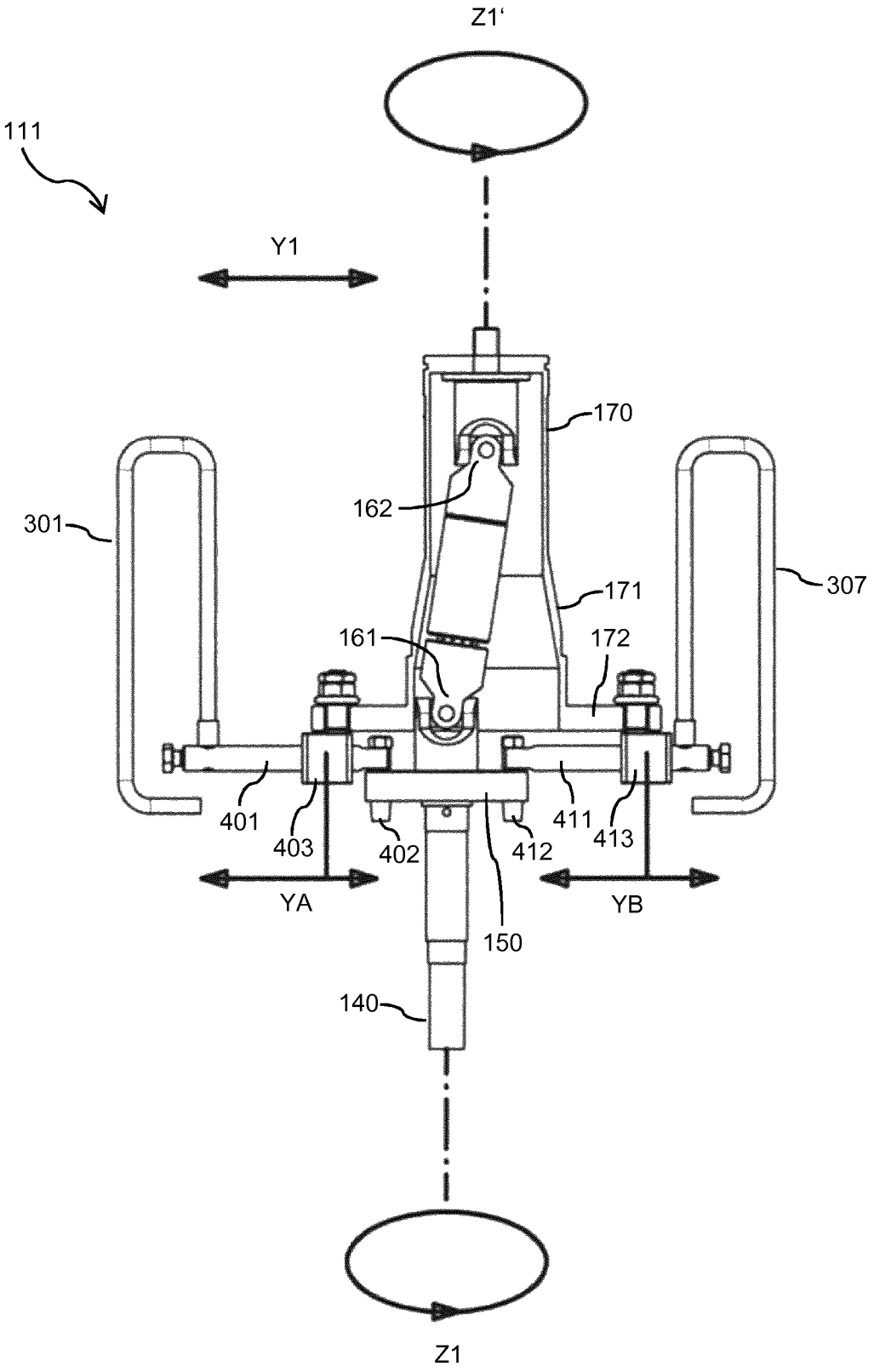
FIG. 3 shows a sectional view of an index wheel of the feed mechanism.

FIG. 3 shows a sectional view for further illustrating the two-part configuration of the first index wheel 111. However, it is to be understood that the second index wheel 112 has a similar two-part configuration.

As illustrated in FIG. 3, the index wheel 111 is provided with a main shaft 140 which is rotatable around the first rotation axis Z1. The main shaft 140 is coupled to the belt drive, i.e., driven by the motor 120. The main shaft 140 carries a first support member 150, which in the illustrated example has a flange-like configuration. At its periphery, the first support member 150 is provided with first support elements 402, 412 which each support a first end of a corresponding shaft element 401, 411 in such a way that the shaft element 401, 411 is tiltable about a tilt axis which extends in parallel to the first rotation axis Z1. In the illustrated example, the first support elements 402, 412 are provided in the form of a hole in the first support element and a pin which is inserted through the shaft element 401, 411 into the hole. However, other implementations of a tilt support could be used as well, e.g., based on-like protrusion extending from the first support element 150 to which the shaft element 401, 411 is coupled by a hole provided in the shaft element 401, 411.

As further illustrated, the index wheel 111 is further provided with a second support member 170 which is rotatable around the second rotation axis Z1'. The second support member 170 is coupled by a Cardan joint mechanism 160 two the first support member 150 and the main shaft 140. Accordingly, the second support member 170 rotates synchronously with the first support member 150, while the Cardan joint mechanism 160 enables the variable parallel shift of the first rotation axis Z1 and the second rotation axis Z1'. In the illustrated example, the Cardan joint mechanism 160 includes a first Cardan joint 161 and a second Cardan joint 162. The Cardan joint mechanism 160 is housed in a conical sleeve 171 of the second support member 170. As illustrated, the conical sleeve 171 limits the parallel shift Y1 of the first rotation axis Z1 and the second rotation axis Z1', because also the first Cardan joint 161, i.e., an end part of the first rotation axis Z1, is enclosed by the conical sleeve 171.

The second support member 170 is provided with second support elements 403, 413 which each support a corresponding one of the shaft elements 401, 411, in such a way that the support element 403 is slidable along the shaft element 401, 411 while at the same time ensuring that the shaft element remains tiltable about the above-mentioned tilt axis. In the illustrated example, this is achieved by providing the support element 403, 413 with a hole through which the shaft 401, 411 extends and by supporting the support element 403, 413 to be tiltable about a tilt axis which extends parallel to the first rotation axis Z1 and the second rotation axis Z1'. In the illustrated example, the second support elements 403, 413 are provided on a flange-like extension of the conical sleeve 171.

The blades 301, 307 of the index wheel 111 are each attached to a second end of the corresponding shaft element 401, 411. In the illustrated example, the blades 301, 307 are provided by a bracket-like wire loop. However, other shapes or configurations of the blades could be used as well. As illustrated, for a given one of the blades 301, 307 the second support element 403, 413 is arranged radially outward with respect to the first support element 402, 412, and the blade 301, 307 is arranged radially outward of the second support element 403, 413. The second support element 403, 413 can slide along the shaft element 401, 411.

The sliding displacement of the second support element 403, 413 depends on the parallel shift Y1 of the first rotation axis Z1 and the second rotation axis Z1'. In the illustration of FIG. 3, the sliding displacement of the second support element 403 is denoted by YA and the sliding displacement of the second support element 413 is denoted by YB. As can be seen, the second support element 403 is located closer to the first end of the shaft element 401 than to the second end of the shaft element 401. As compared to that, the second support element 413 is located closer to the second end of the shaft element 401 than to the first end of the shaft element 401. As the index wheel 111 rotates, the sliding displacement sliding displacement of the second support element 403, 413 along the shaft element 401, 411 varies for each of the bladed 301, 307. For example, when rotating the shaft by 180° with respect to the situation illustrated in FIG. 3, the blades 301 and 307 will have changed their position, and the sliding displacement of the second support element 403 will then be YB while the sliding displacement of the second support element 413 will be YA. This variation of the sliding displacement over a rotation of the index wheel 111 courses variable tilting of the shaft elements 401, 411 and thereby a variation of the spacing of neighboring blades, as further illustrated in FIG. 4.

Figure 4:
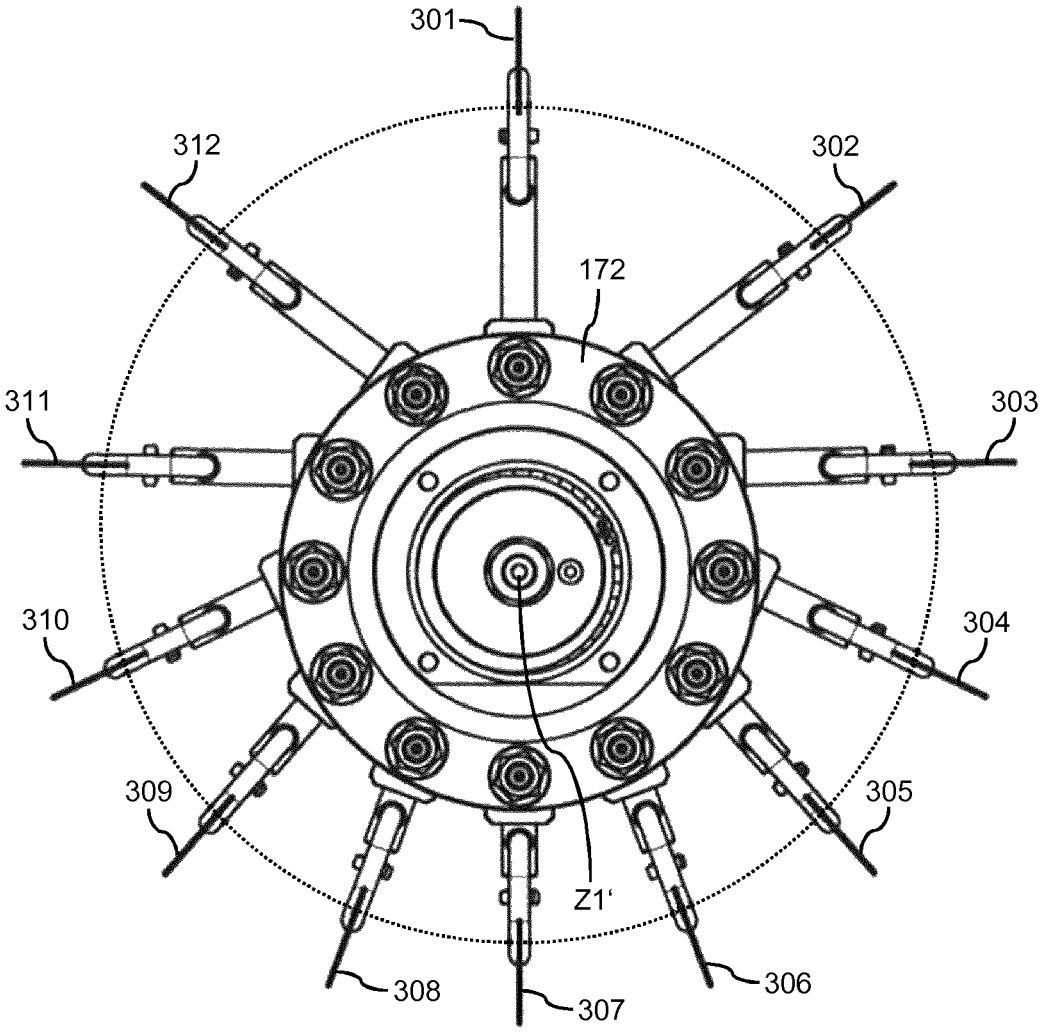
FIG. 4 shows a top view of the index wheel of the feed mechanism.

FIG. 4 shows a top view of the first index wheel 111 with the blades 301, 302, 303, 304, 305, 306, 307, 308, 309, 310, 311, 312. A dotted line illustrates a perimeter of a rotation around the first rotation axis Z1, which due to the parallel shift Y1 is arranged off-center with respect to the second rotation axis Z1'. As can be seen, this has the effect that on one side of the index wheel 111 the spacing between two neighboring blades 301, 302, 303, 304, 305, 306, 307, 308, 309, 310, 311, 312 is larger than on the opposite side of the index wheel 111. If the first rotation axis Z1 and the second rotation axis Z1' are set to be aligned, the spacing between two neighboring blades 301, 302, 303, 304, 305, 306, 307, 308, 309, 310, 311, 312 would be the same over the entire periphery of the index wheel.

As can be seen, the parallel shift of the two rotation axis of the index wheels 111, 112 can be used for adjusting the spacing between two neighboring blades of the index wheel 111, 112. This allows for accommodating the feed mechanism to different spring diameters used in the pocketed spring strand 10. Moreover, the tilting of the shaft elements also allows for providing a reduced tilt angle between neighboring blades which engage the pocketed spring strand, e.g., like shown for the blades 306, 307, and 308 in FIG. 4, so that the blades forming the compartment for pushing the pocketed spring forward are arranged almost perpendicular to the conveying direction. In this way, precision of feeding the pocketed spring strand 10 can be further improved.

It is noted that the above examples are susceptible to various modifications. For example, rather than using a fully regular angular spacing of the support elements for the blades, the support elements for the blades could also be arranged with a variable angular spacing. For example, for a pocketed spring strand having small diameter and large diameter pocketed springs which are arranged in an alternating sequence of small diameter and large diameter, the support elements for the blades could also be arranged according to an alternating sequence of a larger and a smaller angular spacing.

Still further, it is noted that the illustrated concepts are not limited to a feed mechanism using a pair of opposing index wheels. Rather, the index wheels could be arranged in various ways, e.g., by using two or more index wheels rotating in the same direction on the same side of the feed channel for the pocketed spring strand. Further, one or more index wheels could be arranged on only one side of the feed channel for the pocketed spring strand, with a guide surface being provided on the other side of the feed channel. Further, rather than using a motor to set the parallel shift between the first and second rotation axis of the index wheel(s), the parallel shift could also be manually adjustable. Still further, synchronous rotation of the first support member around the first rotation axis and the second support member around the second rotation axis could also be achieved by using separate but synchronized drives for the first support member and the second support member. Moreover, while the illustrated examples assumed a number of 12 blades per index wheel, a higher or lower number of leads per index wheel could be used as well. Still further, various types of blades may be provided on the index wheel(s), without limitation to the above-mentioned bracket-shaped type. Moreover, it is noted that index wheels and mechanisms as illustrated herein could also be used various types of conveying mechanisms, including other purposes than for conveying pocketed string strands.

What is claimed is:

1. A feed mechanism for pocketed spring strands, the feed mechanism comprising:

an index wheel having a plurality of blades for engaging between pocketed springs of a pocketed spring strand; and a motor for driving rotation of the index wheel, wherein the index wheel comprises:

a first support member which is rotatable about a first rotation axis and comprises, for each of the plurality of blades, a first support element which supports a shaft element of the blade to be tiltable about a tilt axis extending in parallel to the first rotation axis, and a second support member which is rotatable about a second rotation axis which extends in parallel to the first rotation axis and comprises, for each of the plurality of blades, a second support element which is slidable along the shaft element of the blade and supports the shaft element to be tiltable about said tilt axis, wherein the first support member and the second support member are movable relative to each other to set a parallel shift of the first rotation axis and the second rotation axis.

2. The feed mechanism according to claim 1, wherein the index wheel further comprises a Cardan joint mechanism coupling the first support member and the second support member.

3. The feed mechanism according to claim 1, wherein the index wheel comprises a sleeve which is arranged coaxially with one of the first rotation axis and the second rotation axis, receives a portion of the other of the first rotation axis and the second rotation axis, and limits the parallel shift of the first rotation axis and the second rotation axis.

4. The feed mechanism according to claim 3, wherein the index wheel further comprises a Cardan joint mechanism coupling the first support member and the second support member; and wherein the sleeve accommodates the Cardan joint mechanism.

5. The feed mechanism according to claim 1, wherein the first support elements are distributed with equal angular spacings around the first rotation axis, and wherein the second support elements are distributed with the same equal angular spacings around the second rotation axis.

6. The feed mechanism according to claim 1, further comprising:

a belt drive mechanism for coupling the motor to the index wheel.

7. The feed mechanism according to claim 1, further comprising:

a further motor for moving the first support member and the second support member relative to each other to set the parallel shift of the first rotation axis and the second rotation axis.

8. The feed mechanism according to claim 1, further comprising:

a further index wheel having a plurality of blades for engaging between the pocketed springs of the pocketed spring strand, wherein the further index wheel comprises:

a third support member which is rotatable about a third rotation axis and comprises, for each of the plurality of blades of the further index wheel, a first support element which supports a shaft element of the blade to be tiltable about a tilt axis extending in parallel to the third rotation axis, and a fourth support member which is rotatable about a fourth rotation axis extending in parallel to the third rotation axis and comprises, for each of the plurality of blades of the further index wheel, a second support element which is slidable along the shaft element of the blade and supports the shaft element to be tiltable about said tilt axis, wherein the third support member and the fourth support member are movable relative to each other to set a parallel shift of the third rotation axis and the fourth rotation axis.

9. The feed mechanism according to claim 8, wherein rotation of the index wheel and rotation of the further index wheel are driven by the same motor.

10. The feed mechanism according to claim 8, a belt drive mechanism for coupling the motor to the index wheel and to the further index wheel.

11. The feed mechanism according to claim 8, wherein the index wheel and the further index wheel are arranged on opposite sides of the pocketed spring strand and rotation of the further index wheel is driven by the motor in a direction which is opposite to rotation of the first index wheel.

12. The feed mechanism according to claim 8, further comprising:

a further motor for moving the first support member and the second support member relative to each other to set the parallel shift of the first rotation axis and the second rotation axis and for moving the third support member and the fourth support member relative to each other to set the parallel shift of the third rotation axis and the fourth rotation axis.

13. The feed mechanism according to claim 12, further comprising:

a spindle drive coupling the further motor to the index wheel and the further index wheel.

14. The feed mechanism according to claim 13, wherein the spindle drive is configured to set the parallel shift of the first rotation axis and the second rotation axis and the parallel shift of the third rotation axis and the fourth rotation axis in a symmetric manner.

15. A pocketed string assembly machine comprising at least one feed mechanism for pocketed spring strands, the feed mechanism comprising:

an index wheel having a plurality of blades for engaging between pocketed springs of a pocketed spring strand; and a motor for driving rotation of the index wheel, wherein the index wheel comprises:

a first support member which is rotatable about a first rotation axis and comprises, for each of the plurality of blades, a first support element which supports a shaft element of the blade to be tiltable about a tilt axis extending in parallel to the first rotation axis, and a second support member which is rotatable about a second rotation axis which extends in parallel to the first rotation axis and comprises, for each of the plurality of blades, a second support element which is slidable along the shaft element of the blade and supports the shaft element to be tiltable about said tilt axis, wherein the first support member and the second support member are movable relative to each other to set a parallel shift of the first rotation axis and the second rotation axis.

* * * * *